US007401612B2

(12) United States Patent
De Laforcade

(10) Patent No.: US 7,401,612 B2
(45) Date of Patent: Jul. 22, 2008

(54) DEVICE, METHOD, AND SYSTEM FOR APPLICATION OF A HAIR PRODUCT

(75) Inventor: Vincent De Laforcade, Rambouillet (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 10/740,438

(22) Filed: Dec. 22, 2003

(65) Prior Publication Data

US 2004/0182408 A1 Sep. 23, 2004

Related U.S. Application Data

(60) Provisional application No. 60/442,892, filed on Jan. 28, 2003, provisional application No. 60/442,893, filed on Jan. 28, 2003.

(30) Foreign Application Priority Data

Dec. 23, 2002 (FR) ..... 02 16577
Dec. 23, 2002 (FR) ..... 02 16578

(51) Int. Cl.
*A45D 24/22* (2006.01)
*A46B 9/04* (2006.01)

(52) U.S. Cl. ..... 132/112; 15/188

(58) Field of Classification Search ..... 132/112, 132/108, 111–116; 401/10, 28, 45, 7; 15/227, 15/188; 2/21
See application file for complete search history.

(56) References Cited

U.S. PATENT DOCUMENTS 720,847 A * 2/1903 Sanford ..... 15/188
1,062,053 A * 5/1913 Strong ..... 401/45
1,064,641 A * 6/1913 Halstead ..... 401/28
1,450,817 A * 4/1923 Porter ..... 401/8
1,497,036 A * 6/1924 Skoglund ..... 132/313
1,515,525 A * 11/1924 Stevens ..... 132/107
1,997,944 A * 4/1935 Ogden, Jr. et al. ..... 132/107
2,075,413 A * 3/1937 Welker ..... 401/7
2,463,611 A * 3/1949 Green et al. ..... 132/108
2,492,278 A * 12/1949 Foster ..... 15/227

(Continued)

FOREIGN PATENT DOCUMENTS

DE 28 34 801 2/1980

(Continued)

OTHER PUBLICATIONS

English language Derwent Abstract of DE 28 34 801, Feb. 21, 1980.

(Continued)

*Primary Examiner*—Robyn Doan
(74) *Attorney, Agent, or Firm*—Finnegan, Henderson, Farabow, Garrett & Dunner, L.L.P.

(57) ABSTRACT

A device for application of a hair product includes an applicator portion configured to be loaded with hair product and at least one finger fastener associated with the applicator portion. The applicator portion may include a container and be configured to apply the hair product to at least one strand of hair in response to manual pressure exerted on the container when the device is moved longitudinally relative to the strand of hair. The finger fastener may be configured to allow the device to be fixed to at least one finger of a hand.

41 Claims, 3 Drawing Sheets

U.S. PATENT DOCUMENTS

| | | | | | |
|---|---|---|---|---|---|
| 2,705,499 | A | | 4/1955 | Breeze | |
| 2,722,706 | A | | 11/1955 | Chopp | |
| 3,151,346 | A | * | 10/1964 | Gray | 15/187 |
| 3,176,338 | A | * | 4/1965 | Homburger | 401/7 |
| 4,543,913 | A | * | 10/1985 | Wilkeson | 119/603 |
| 4,691,720 | A | | 9/1987 | Schmitz | |
| 4,766,914 | A | * | 8/1988 | Briggs | 132/212 |
| 6,062,231 | A | | 5/2000 | De Laforcade | |

FOREIGN PATENT DOCUMENTS

| | | |
|---|---|---|
| EP | 0 988 812 | 3/2000 |
| FR | 1 271 648 | 8/1961 |
| FR | 2 443 223 | 7/1980 |
| JP | U H04-056022 | 5/1992 |
| JP | A H11-178630 | 7/1999 |

OTHER PUBLICATIONS

English language Derwent Abstract of EP 0 988 812, Mar. 29, 2000.

* cited by examiner

DEVICE, METHOD, AND SYSTEM FOR APPLICATION OF A HAIR PRODUCT

This application claims benefit of priority under 35 U.S.C. § 119(e) of U.S. provisional application No. 60/442,892, filed Jan. 28, 2003, and U.S. provisional application No. 60/442,893, filed Jan. 28, 2003. Additionally, this application claims priority to French application no. 0216577, filed Dec. 23, 2002, and French application no. 0216578, filed Dec. 23, 2002.

BACKGROUND OF THE INVENTION

1. Field of the Invention

The present invention relates to a device for application of a hair product, such as a highlight product. The device according to the invention may be particularly suitable for self-application of a dyeing product to strands of hair.

2. Description of the Related Art

"Highlight" dyeing is a treatment in which only certain parts of the head of hair are impregnated with dyeing product. Once the dyeing treatment is completed, the head of hair obtains a non-uniform colour effect. Because the head of hair has colour shades brighter or darker than the natural or overall shade of the head of hair, some particular movements of the head of hair may become emphasized.

There are several types of dyeing products for hair. Exemplary types of hair dyeing products include temporary dyeing, semi-permanent dyeing, and permanent dyeing referred to as oxidation.

Dyeing products may be in the form of a cream, a foam, or a liquid with a more or less high viscosity. Dyeing products in liquid or gel form may be applied, optionally after mixing, by using a porous means such as foam (e.g., a foam sponge). The most viscous and the most paste-like products are contained in bowls after mixing a bleaching powder and an oxidant in the bowl.

In order to apply these products that are contained in bowls, known application devices use either a comb or a thin brush, or a combination of the two. Such devices are described, for example, in French Patent Publication No. 2,764,488 and U.S. Pat. No. 4,691,720.

At least some known comb and/or brush devices generally suffer from drawbacks, in particular, due to the fact that they are used by approaching the head of hair from its outside, that is to say, on top. As the applicator subsequently moves relative to the strand of hair from the root to the tip, the product is deposited essentially on the surface of the strand of hair, and not very much inside. During this movement, however, experience has shown that the user tends to lift the applicator and make it depart from a path following the curvature of the skull. For this reason, a number of hairs become separated from the applicator and fall back onto the head of hair. If, for example, a dyeing product is used, these hairs will not be dyed. The result obtained is sometimes far from satisfactory.

In the case of self-application of the product by a user, at least some known devices may be difficult for the user to handle and may make highlights difficult to apply on the rear of the head. This is because these devices may be difficult to position accurately when applying hair product to a portion of hair that is outside the user's direct field of view.

Furthermore, when using a thin brush and depositing a very paste-like product, it may be difficult to spread the product over the whole length of the strand of hair.

An additional known device is described in U.S. Pat. No. 2,705,499, which discloses an applicator in scissor form, having two branches hinged about a pivot. This patent describes a first branch having two comb rows, between which a pad impregnated with product is placed, and a second branch formed by a brush that can bear against the impregnated pad. Conventional applicators of this general type are expensive and complex to produce, since they are obtained by assembling a plurality of mechanical parts. Furthermore, the hinge of the branches of such an applicator often poses a problem when hairs or some of the product obstructs the hinge of the two branches.

In other conventional applicators, such as those described in U.S. Pat. No. 2,722,706 and German Patent Publication No. DE-28,34,801, the applicators are made from a glove or a fingerstall provided with a dispenser level with an inner face of the hand or the finger-bone. In these applicators, the dispenser is impregnated with product.

These conventional applicators also pose a problem, since they are made of a material that is necessarily different from the dispenser capable of coating the product. In particular, the gloves or fingerstalls of these applicators are made of an impermeable material, whereas the dispensers are made of materials that are permeable to the product. Furthermore, the gloves are not easy to handle for self-application of the product to the head, since the liquid with which the dispenser is impregnated can easily trickle down along walls of the glove without ever coating the head of hair. Fingerstalls, moreover, present an additional problem because they may inadvertently rotate around the finger, in particular during a longitudinal movement along a strand of hair.

For these and other reasons, there is a need for alternative approaches that may limit or avoid one or more drawbacks of the related art.

SUMMARY

In the following description, certain aspects and embodiments of the present invention are disclosed. It should be understood that the invention, in its broadest sense, could be practiced without having one or more features of these aspects and embodiments. In other words, these aspects and embodiments are merely exemplary.

One aspect may relate to a device that limits or overcomes one or more drawbacks of the related art. In some examples, the device may facilitate self-application of a hair product, such as a "highlight" product.

Another aspect relates to a device that may include an applicator portion for application of hair treatment product, and fastener portion (e.g., fixing portion) for fastening (e.g., fixing and/or presenting) the applicator portion level with an end of a finger. (As used herein, the term "finger" includes any one of the five fingers on an individual's hand, including the thumb.)

In at least some examples, the applicator portion may have a desired ergonomic nature. For example, it may be possible to obtain a suitable result without using great dexterity.

In some examples, the fastener portion may press the finger against an outer face of a flat base of the applicator portion in order to improve fastening around the finger.

In another aspect, the applicator portion may include a manually compressible container. The container of the applicator portion may contain a dose of product and release it when one of its walls is compressed. For example, one or more walls of the container may be at least partly compressed in order to reduce their height with respect to the fastener portion.

In at least some examples, in order to coat the strand of hair, the container may be compressed progressively during a longitudinal movement along the strand of hair, by sliding from the roots towards the tips. The strand of hair may be impregnated uniformly, without depositing lumps even if the product is paste-like, and the widths of the highlights produced in this way may be easy to reproduce, at least sometimes making it possible to obtain a uniform result over the entire head of hair.

In another aspect, the applicator portion may include teeth that may stand upright relative to a base of the applicator portion, so as to provide a central depression defined with respect to a surface delimited by the ends of the teeth taken together, the central depression forming the container. These teeth may also be compressible.

In at least some examples, in order to compress the container and discharge the product onto the strand of hair, the strand of hair may be physically gripped between an opening of the container of the applicator portion and at least one other finger of the hand. In these examples, a compression force may be applied on a base of the container, by means of at least one finger placed in the finger fastener on an outer face of the base, and the container may be compressed between the at least one finger and the other finger of the hand.

In yet another aspect, the container may be compressed so that the gripping is exerted laterally on a wall delimiting the opening in which the strand of hair is placed.

In a further aspect, the fastener portion may be adjusted to the diameter of the finger on which it is fitted. To this end, the fastener portion may have, for example, two tabs that may be connected to one another. For example, a first tab may be configured to be inserted into a hole of a second tab, and one of the tabs may have a plurality of levels for fixing the first tab with the second tab. The two tabs may make it possible to fix the finger fastener around an anterior part of the finger.

In another aspect, in order to avoid pinching the finger around which it is fitted, at least one tab may have two arcs. The two arcs may be attached level with the applicator portion, and may be joined together so that they may be connected collectively to the second tab. The position of the arcs may provide the applicator portion with great stability on the lower face of the finger around which it is fitted.

In an even further aspect, in order to correctly position the applicator portion at the last bone of the finger around which it is fitted, the applicator portion may have a stop on an outer periphery. The stop may limit the insertion of the finger into the fastener portion.

In still another aspect, the device may be formed of a single piece. For example, the single piece may be obtained by moulding. In some examples, the single piece arrangement may reduce the manufacturing costs and facilitate the production and packaging of the device.

In yet another aspect, a holding member may be used. For example, the holding member may facilitate the compression of the container. The holding member may act as a support for placing the strand of hair in front of and against an opening of the container. This holding member may be engaged on the other finger by a fastener portion similar to the fastener portion of the applicator portion. In order to fulfil a function of guiding the fingers that are fitted around the applicator portion and the holding member, the applicator portion may be connected to the holding member by a connecting element, such as a flexible strip.

In a further aspect, in order to coat the strand of hair placed between the applicator portion and the holding member, the applicator portion and holding member may be moved simultaneously along the strand of hair by sliding them from the roots towards the tips. For example, the connecting element may form a guide for the simultaneous movement of the two components. The strand of hair may be thus physically gripped between the two fingers of the hand, which may make the movement of the device along the strand of hair more reliable and more straightforward.

In still another aspect, the holding member may cooperate with an opening of the container. For example, the holding member may obtain progressive dispensing of the product contained in the container. In some examples, the holding member may be folded onto the opening so that the strand of hair may be gripped between the opening of the container and the holding member. Pressure may then be exerted both on an outer periphery of the base of the container and on an outer periphery of the holding member. The pressure may be obtained by gripping between the at least two fingers, for example, between the thumb and index finger of the same hand.

In yet another aspect, the applicator portion and/or the holding member may have teeth configured to cooperate with the strand of hair. When a strand of hair is gripped between the applicator portion and the holding member, the teeth may ensure that the strand of hair may remain between these two elements and become coated over its full length with the hair product.

In an even further aspect, the holding member may form a second applicator portion. In some examples, this may improve application of the hair product on the strand of hair. The second applicator portion may be capable of holding some of the product. The two applicator portions may then be pressed towards one another, on either side of the strand of hair. The strand of hair may thus be impregnated more favourably with product. In at least one example, the holding member may be the mirror image of the applicator portion relative to an axis orthogonally intersecting the connecting element, which joins them together.

One more aspect relates to a device for application of a hair product. The device may include an applicator portion configured to be loaded with hair product and at least one finger fastener associated with the applicator portion. The applicator portion may include a container. The applicator portion may be configured to apply the hair product to at least one strand of hair in response to manual pressure exerted on the container when the device is moved longitudinally relative to the strand of hair. The finger fastener may be configured to allow the device to be fixed to at least one finger of a hand.

In at least some examples, the device may be configured to apply hair product in a highlight manner.

In one aspect, the container is compressible.

In another aspect, the finger fastener may include at least one tab configured to be placed at least in part around the at least one finger. In some examples, the device may include a first tab and a second tab configured to be connected to one another.

In still another aspect, the finger fastener may include at least one tab elastically deformable configured to be placed at least in part around the at least one finger. As one of ordinary skill in the art should readily recognize, such an "elastically deformable tab" is not disclosed in U.S. Pat. No. 2,705,499, U.S. Pat. No. 2,722,706, French Patent Publication No. 1,271,648, or German Patent Publication No. DE-28,34,801.

In yet another aspect, the applicator portion and the finger fastener comprise the same material (e.g., the same type of material and/or the are formed of single piece of material). As one of ordinary skill in the art should recognize, an arrangement with an applicator and finger fastener comprising the same material is not disclosed in U.S. Pat. No. 2,722,706 or German Patent Publication No. DE-28,34,801. In some examples, one wall of the container may be compressible in response to a force exerted orthogonally relative to a base on which the finger fastener is located.

For some examples, at least one wall of the container may be defined by teeth that stand upright relative to a base of the container, these teeth delimiting a central depression defined with respect to a surface, which is delimited by the ends of the teeth taken together.

Some examples may have one wall of the container forming a bellows. For example, the bellows may include a shape-memory coil spring.

In another aspect, the finger fastener may be adjustable so as to fix the device to differing sizes of fingers. For example, the finger fastener may be adjustable as a function of a size of the at least one finger around which it is fitted.

Some examples include two tabs. The tabs may extend in two opposite directions along the same axis. Optionally, the tab or tabs may extend in a plane formed by a base of the container.

In a further aspect, one or more tabs may be attached to a base of the container by at least two arc-shaped portions. In a further example, the two arc-shaped portions may be elastically deformable.

In some examples, the finger fastener may have a stop on an outer periphery of the container, in order to limit the insertion of the finger relative to the finger fastener.

In an even further aspect, the device may include a holding member capable of cooperating with the container in order to hold the strand of hair in engagement with the container, so as to allow it to be coated with the product. For example, the holding member may be folded onto an opening of the container so as to grip the strand of hair between the opening and the holding member. Pinching (e.g., squeezing) a base of the container and the holding member on either side of the strand of hair may exert pressure on the container. Optionally, the holding member may have a plate with a size larger than a size of an opening of the container.

In one more aspect, the holding member may include teeth.

In still another aspect, the holding member may be at least substantially the same (or even the same) as the application means.

In an even further aspect, the holding member may include a second finger fastener, which may be configured to be fixed to at least one second finger. For example, the second finger fastener may include at least one elastically deformable tab configured to be placed (e.g., held) at least in part around the second finger. In some examples, the first and/or second finger fastener may include two elastically deformable tabs capable of being connected to one another.

In another aspect, the holding member may be connected to the container by a flexible linking strip. For example, the tab or tabs may extend orthogonally to the flexible strip.

In yet another aspect, the device may be formed from a single piece of material, for example, obtained by moulding.

A further aspect relates to a system including a device as described herein in combination with a hair product. For example the hair product, may be a dyeing product, such as a dyeing product intended to apply highlights to hair.

Yet another aspect relates to a method for applying hair product. The method may include providing a device including an applicator portion configured to be loaded with hair product and at least one finger fastener configured to allow the device to be fixed to at least one finger of a hand; fixing the device to the at least one finger of the hand via the finger fastener; sandwiching the at least one strand of hair between at least one other finger of the hand and at least a part of the device; and exerting manual pressure on the applicator portion so as to apply the hair product to the at least one strand of hair.

The term "providing" is used broadly herein, and refers to, but is not limited to, making available for use, giving, supplying, obtaining, getting a hold of, acquiring, purchasing, possessing, manufacturing, making ready for use, and/or placing in a position ready for use.

In another aspect, the method may include moving the device longitudinally relative to the at least one strand of hair.

In a further aspect of the method, the hair product may be applied in a highlight manner.

In one more aspect, the manual pressure exerted on the container may cause compression of the container.

In still another aspect, the device may include a holding member, and wherein the method may include using the holding member to hold the at least one strand in engagement with the container.

In yet another aspect, the holding member may include a second finger fastener, and the method may include fixing the second finger fastener to the at least one other finger.

Aside from the structural procedural arrangements set forth above, the invention could include a number of other arrangements such as those explained hereinafter. It is to be understood that both the foregoing description and the following description are exemplary only.

BRIEF DESCRIPTION OF THE DRAWINGS

The accompanying drawings are incorporated in and constitute a part of this specification. The drawings illustrate exemplary embodiments and, together with the description, serve to explain some principles of the invention. In the drawings.

DESCRIPTION OF A FEW EXEMPLARY EMBODIMENTS

Figure 1:
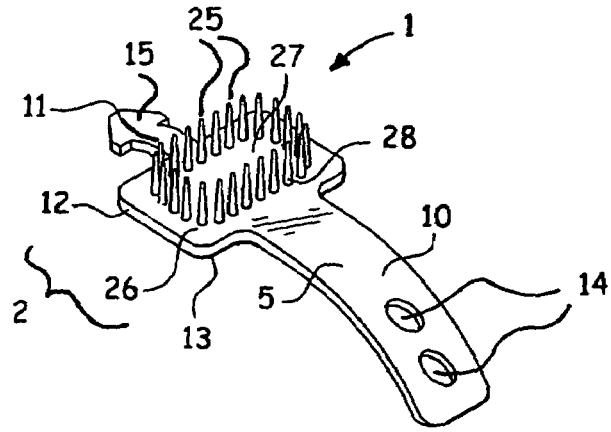
FIG. 1 shows a perspective view of an embodiment of a device according to the invention.

Reference will now be made in detail to a few exemplary embodiments of the invention. Wherever possible, the same reference numbers are used in the drawings and the description to refer to the same or like parts.

FIG. 1 shows an embodiment of a device 1. The device 1 may have an applicator portion 2. The applicator portion 2 may have a base 12 and a container 27 located on an inner face 26 of the base 12. A dose of product may be stored in the container 27. The container 27 may be a manually compressible container, e.g., the product stored in the container 27 may be expelled by compressing at least one wall 28 defined by teeth 25 of the container 27. (Four walls 18 arranged to define a rectangular shape are shown in FIG. 1.) These walls 28 stand upright on the base 12 of the applicator portion 2 and are compressed so as to reduce the volume defined by the container 27.

When a strand of hair is applied against an opening of the container 27, the walls 28 may be compressed progressively so as to deposit some of the product along the strand of hair when the applicator portion 2 is moved longitudinally relative to the strand of hair.

The device 1 may have at least one finger fastener 5 (e.g., a fixing portion) for being fitted on at least one finger 9 (see FIG. 3) of a hand 7. The inner face 26 and outer face 13 face in opposite directions. The inner face 26 and outer face 13 are defined with respect to the position of the finger 9, which is engaged by the finger fastener 5 on the applicator portion 2. In other words, the outer face 13 corresponds to the face on the same side as the finger 9, whereas the inner face 26 corresponds to the face on the same side as the container 27, which is configured to come in contact with the strand of hair.

In the embodiment of FIG. 1, the teeth 25 cooperate with the strand of hair to be coated and possibly improve application of the production the strand of hair. The teeth 25 may stand upright on some or all of the surface presented by the inner face 26. The teeth 25 may be arranged in rows, for example, in proximity to the border of the inner face 26. In FIG. 1, rows of teeth 25 form the walls 28 and may be compressible.

The teeth 25 preferably stand orthogonally to the inner face 26. They may have a height that varies between them, relative to a plane defined by the inner face 26. When the teeth 25 are arranged on some or all of the periphery of the inner face 26, a central depression is defined between these teeth 25. The central depression may also be defined with respect to a surface delimited by the ends of the teeth 25 taken together. In this embodiment, the depression corresponds to the region of the inner surface 26 where the teeth 25 are shortest, and forms the container 27. The presence of the teeth 25 makes it possible to store a dose of product, especially when the latter is paste-like.

Figure 2:
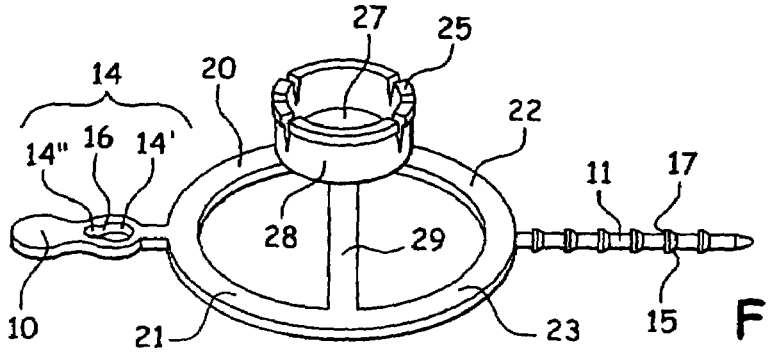
FIG. 2 shows a perspective view of an alternative embodiment of the device according to the invention.

In another embodiment, as presented in FIG. 2, the container 27 is defined by a continuous wall 28 that extends beyond a border of the container base. In this embodiment, the teeth 25 are mutually continuous at their bases. The teeth 25 form a crenellation level with the border defining the opening of the container 27. The crenellation is, for example, present on portions of borders of the wall 28, which lie substantially in the axis along which the strand of hair is intended to be arranged relative to the applicator portion 2. In this case, the teeth 25 fulfil a comb function.

Figure 3:
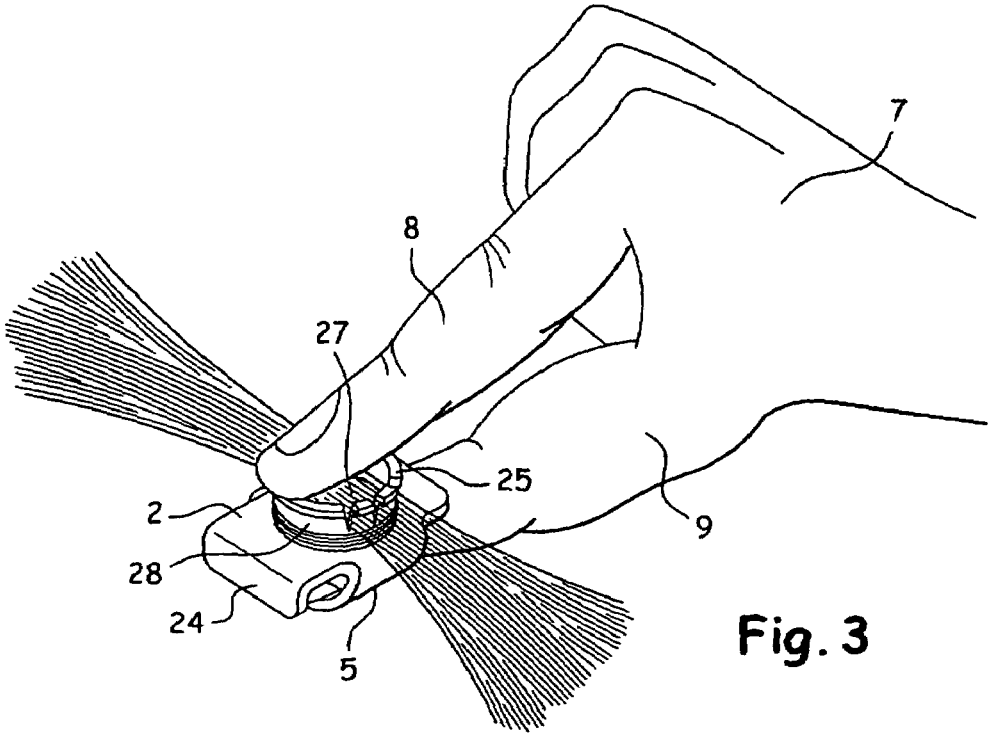
FIG. 3 shows a perspective view of a third embodiment of the device being used to apply a hair product.

For example, the container 27 may have an open cylindrical shape or an open parallelepiped shape. As shown in FIG. 3, which shows an embodiment similar to that of FIG. 2, but having a differing finger fastener 2, the strand of hair is intended to be applied against the opening of the container 27.

The manual pressure may be exerted orthogonally on the outer face 13 of the base 12. It is, for example, obtained by squeezing. As illustrated in FIG. 3, in order to compress the container 27 and discharge the product onto the strand of hair, the finger 9 engaged in the finger fastener 5 exerts pressure on the outer face 13 and at least one second finger 8 cooperates with the finger 9 engaged in the finger fastener 5.

In the embodiments of FIGS. 1, 2, and 3, the second finger 8 is arranged facing the opening of the container 27, and the strand of hair to be coated is arranged between the second finger 8 and the opening of the container 27. The first finger 9 and second finger 8 may be either fingers on the same hand 7, as shown in FIG. 3, or fingers of different hands. The fingers 8 and 9 that may be selected to perform a highlight application of product may be, for example, the index finger and the thumb of the same hand 7, as depicted in FIG. 3.

The wall 28 of the container 27 may be compressed under the effect of manual pressure. Optionally, the wall 28 may have a shape memory. That is, after a first compression, if the pressure is relaxed, the wall 28 stands up to re-form the container 27 with its maximum interior volume. The wall 28 may then be loaded again with a quantity of product to be applied on another strand of hair.

The container 27 may be made of a flexible material. For example, the flexible material may have a hardness of between 30 and 150 Shore A, e.g., a hardness equal to 60 Shore A. The material may be selected from SEBS (sequenced styrene-ethylene-butadiene) polymers or injection-mouldable thermoplastic rubbers, such as Santoprene® (available from Monsanto), or more generally a thermo-elastomeric material.

Figure 3A:
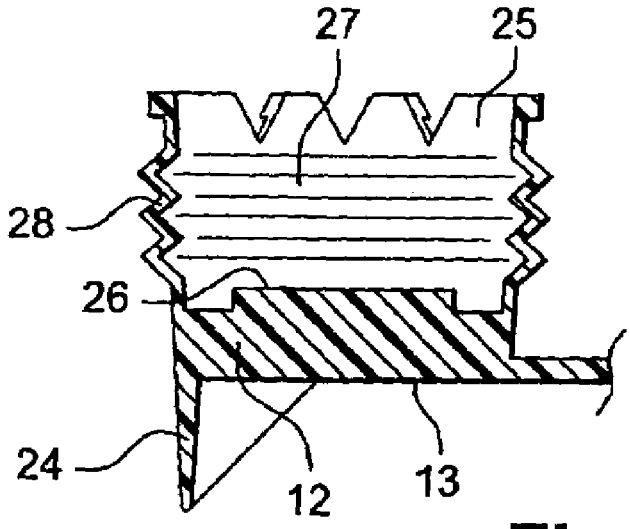
FIG. 3*a* shows a cross-section view of an exemplary container for the device of FIG. 3, wherein the container is shown in a compressed condition.
Figure 3B:
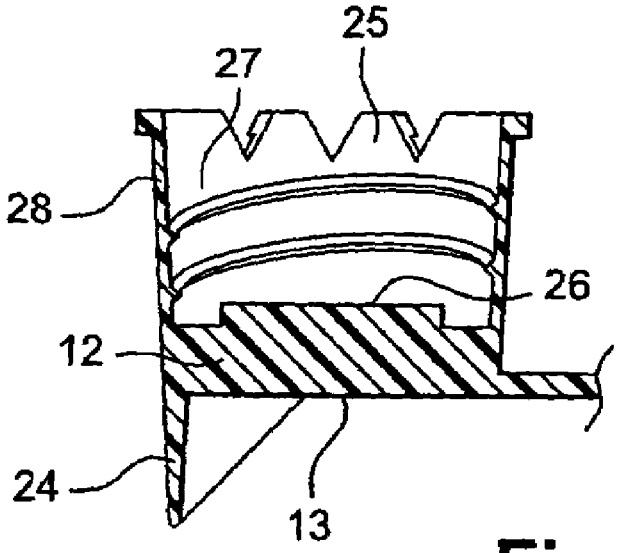
FIG. 3*b* sis a view similar to that of FIG. 3*a* showing the container in an uncompressed condition.

In an embodiment depicted in FIGS. 3*a* and 3*b*, the wall 28 of the container 27 may have bellows elements that can be compacted onto one another under the effect of pressure. In order to resume its initial shape, the wall 28 may be provided with a coil spring as shown in FIG. 3*b*, for example, one that is produced as a rib of the wall 28. The coil spring also may define the preferential folding lines of the wall 28.

Figure 4:
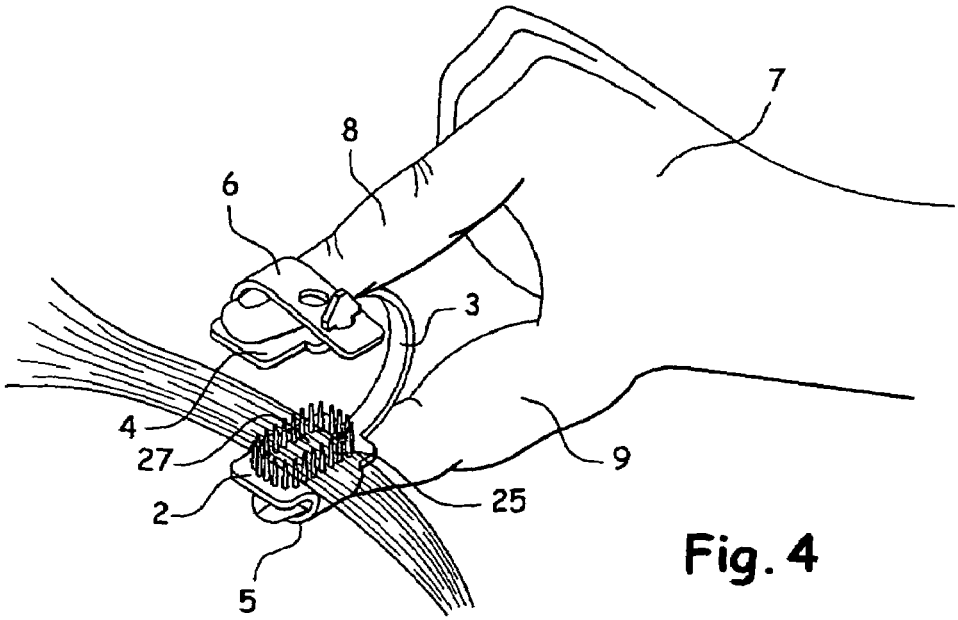
FIG. 4 shows a perspective view showing a fourth embodiment of the device being used to apply a hair product.

According to the embodiment depicted in FIG. 4, a holding member 4 cooperates with the opening of the container 27, and the strand of hair to be coated is arranged between the holding member 4 and the opening. In this embodiment, the applicator portion 2 and the holding member 4 are each equipped with a finger fastener 5 and 6, respectively. These finger fasteners 5 and 6 are configured to be fitted on at least two of a user's fingers 8 and 9.

In the embodiment depicted in FIG. 4, the device 1 may be fitted on fingers 8 and 9 of the same hand 7 of a user. The applicator portion 2 is placed on finger 9, which is a thumb, of hand 7 by the first finger fastener 5. Correspondingly, the holding member 4 is placed on the index finger 8 of the same hand 7 by means of the second finger fastener 6.

The holding member 4 is configured to permit improved compression of the walls 28. This is because the holding member 4 provides a rigid interface between which the walls 28 may be pressed. The holding member 4 allows the walls 28 to be pressed more firmly than the inner face of the second finger 8 could press without a holding member 4. Using a holding member 4 also permits the opening of the container 27 to have larger dimensions than the surface area of the inner face of the second finger 8. With this embodiment, it may be easy to produce highlights with a width larger than that of a finger-bone.

The finger fasteners 5 and 6 may each employ different fastening (e.g., fixing) mechanisms. In an exemplary embodiment, they are produced in the same way. The different variants of the fixing devices are described with respect to the finger fastener 5, but it should also be understood that the finger fastener 6 may be configured like the finger fastener 5, with the holding member 4 substituted for the applicator portion 2, where appropriate.

Figure 5:
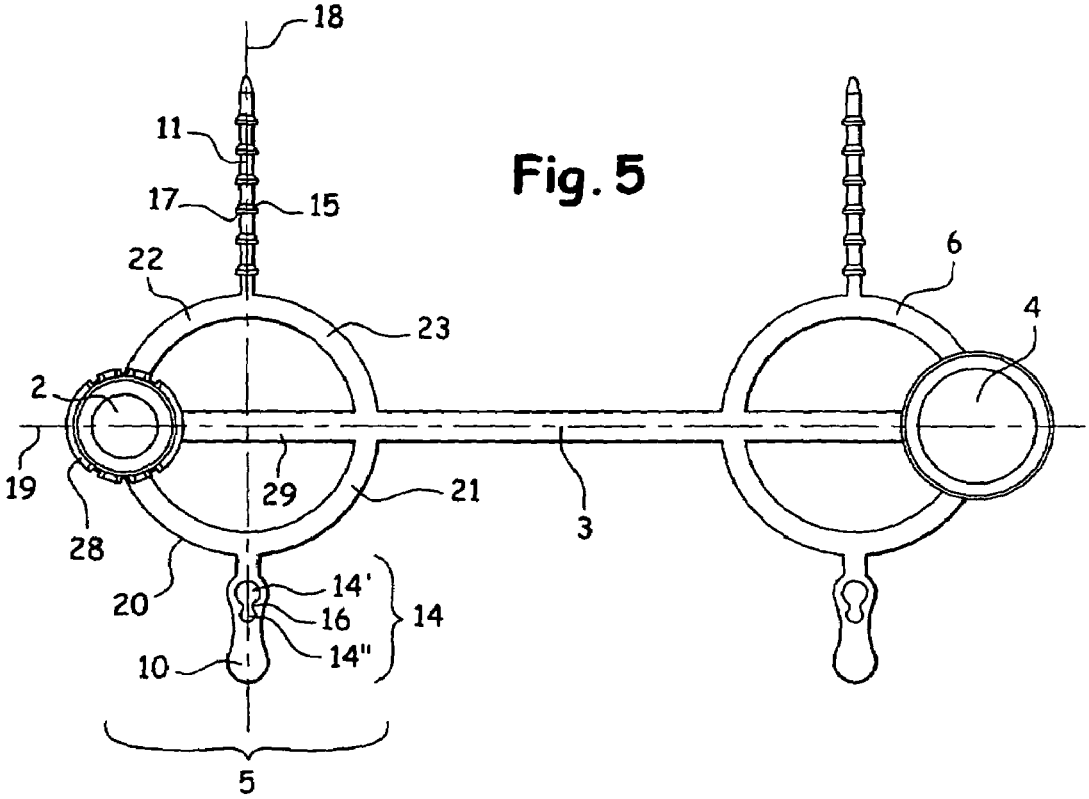
FIG. 5 shows a top view of fifth embodiment of the device.

In the exemplary embodiment depicted in FIG. 5, the finger fastener 5 may have a first tab 10 configured to cooperate with a second tab 11. These tabs 10 and 11 form straps, which may be connected to one another. For example, these tabs 10 and 11 are defined in continuation of the base 12 formed by the applicator portion 2. In this embodiment, the tabs 10 and 11 extend in mutually opposite directions. These tabs 10 and 11 are configured to have some degree of flexibility and may be curved in the direction of one another above the outer face 13 of the base 12. In order to be connected together, the tabs 10 and 11 each have a connecting portion, which are complementary to one another.

In some embodiments, the finger fastener 5 may be adjusted. In particular, the finger fastener 5 may be adjusted to a dimension of a finger around which it is fitted, for example, the finger's diameter. In the exemplary embodiment depicted in FIG. 5, for example, the first tab 10 may have a plurality of holes 14, into which a projection 15 of the second tab 11 may be inserted. For example, the second tab 11 in turn also may have a plurality of projections 15. The two tabs 10 and 11 thus have means of adjustment.

In an alternative embodiment, projection 15, as depicted in FIG. 1, is forcibly inserted into hole 14.

In another embodiment, as depicted in FIG. 2, the projection 15 may be inserted without forcing. In this embodiment, the hole 14 may have a shape similar to that depicted in FIGS. 2 and 5. In particular, the hole 14 may have a shape corresponding to two circular openings 14' and 14", which are connected to one another by a neck 16. In this embodiment, the circular openings 14' and 14" do not have the same diameter. The projection 15 may thus be inserted into the larger-diameter opening 14' and, once inserted, it may slide through the neck 16 so as to bring it into the smaller diameter opening 14", for securing the projection 15. When considering the design of hole 14 of the first tab 10, the smaller diameter orifice 14" may be further away from the applicator portion 2 than hole 14'. This is because with such a configuration, in so far as the tabs 10 and 11 are constrained to be connected, the tabs 10 and 11 will have a tendency to move away from one another and the holding of the projection 15 remains in the smaller diameter opening 14". Therefore, the embodiments depicted in FIGS. 2 and 5 may have the hole 14" positioned further away from projection 15 than hole 14'.

In the embodiment depicted in FIGS. 2 and 5, the second tab 11 may have an elongated tubular shape. In this embodiment, projection 15 corresponds to a chamfered collar, a foot 17, which is of larger diameter than the diameter of the tube of the second tab 11, beyond which it extends. The chamfer is oriented so that the foot 17 is relatively closer to the applicator portion 2. In this embodiment, the larger diameter 14' of the opening is greater than the diameter of the foot 17. Additionally, the smaller diameter 14" of the opening is greater than the diameter of the tube, but less than that of the foot 17.

In another embodiment, the finger fastener 5 is in the form of a fingerstall (not shown), into which at least one finger may be inserted. In this embodiment, the fingerstall extends beyond the outer face 13 of the applicator portion 2.

In an alternative embodiment (not shown), the finger fastener 5 may have a single tab that is configured to cooperate with a complementary means located on the outer surface of the applicator portion 2.

According to another embodiment, which is depicted in FIG. 1, the tabs 10 and 11 may extend along an axis 18, which is secant to the applicator portion 2. The last bone of the finger may be placed level with the outer face 13 of the base 12. This position may offer greater precision for the application of the hair product.

In an exemplary embodiment as depicted in FIG. 5, the tabs 10 and 11 extend along two opposite directions of the same axis 18.

According to another embodiment, and in order to avoid the pinching that could be caused by the finger fastener 5, a tab 10 may be divided into two arcs 20 and 21. For example, as depicted in FIG. 5, the tab 10 may have a first arc 20 and a second arc 21. The two arcs 20 and 21 diverge from the portion of the tab 10 on which the connecting means is located, in this case, the holes 14, before being attached to the applicator portion 2 at two separate points. An open space is defined between the arcs 20 and 21. Alternatively, the space defined between the arcs 20 and 21 may be solid, which might enable a configuration having a tab that is greater in proximity to the applicator portion and has a thinner level with the connecting means.

In the embodiment of FIG. 5, the applicator portion 2 is connected to the holding member 4 by a connecting element 3, the first arc 20 is connected to the periphery of the base 12 of the applicator portion 2, and the second arc 21 is connected directly to the connecting element 3.

In the embodiment of FIG. 5, the second tab 11 may also have two arcs 22 and 23. These arcs 22 and 23 are connected in the same way and, as seen from FIG. 5, delimit the contours of a circle when combined with arcs 20 and 21. A segment 29 extends along a diameter of the circle, and the tabs 10 and 11 extend radially, and orthogonally to the segment 29, towards the outside of the circle. The segment 29 is arranged in the axis of the finger on which the applicator portion 2 is fitted, and the tabs 10 and 11 enclose the finger so as to be connected on the rear side of the corresponding hand. The applicator portion 2 is arranged on the segment 29. For example, as depicted in FIG. 5, the applicator portion 2 is arranged at one end of the segment 29.

In this embodiment, the segment 29 corresponds to a part of the connecting element 3, and the arcs 20, 21, 22, and 23 may all be connected either to the connecting element 3 or to the applicator portion 2.

Additionally, and as depicted in FIGS. 3, 3*a*, and 3*b*, the finger fastener 5 may comprise a stop 24. The stop 24 may improve the positioning of finger 9 relative to the applicator portion 2, level with which it is fitted. In this exemplary embodiment, the stop 24 stands orthogonal to the outer face 13 of the base 12 and extends beyond a border of the outer face 13.

The base 12 may, for example, have a rectangular or oval shape. Depending on the shape of the base 12, the stop 24 may have a straight shape, as depicted in FIGS. 3, 3*a*, and 3*b*, or a curved shape (not shown). If the stop 24, as seen from above, has a substantially U-shape, the finger may abut the hollow of the U.

As depicted in the embodiment of FIG. 5, the connecting element 3 may be, for example, a connecting strip that extends along an axis 19 between the applicator portion 2 and the holding member 4. The axis 18 of the tabs 10 and 11 is then, for example, perpendicular to the axis 19. According to the embodiment depicted in FIG. 5, the axis 18 of the tabs 10 and 11 is secant to the connecting element 3. This exemplary embodiment allows fixing around an anterior part of the end of a finger.

In the embodiment of FIGS. 4 and 5, the holding member 4 may have a flat blade with a shape substantially identical to that of the opening of the container 27. In the example of FIG. 5, the blade is round and has a diameter slightly larger than that of the opening of the container 27. When the strand of hair is supported by the holding member 4, the periphery of the opening of the container 27 may be pressed against the blade. Squeezing, that is to say bringing the two fingers 8 and 9 towards one another, makes it possible to compress the walls 28 of the container 27 between the base 12 and the blade. The periphery of the opening is notched so as to let the product emerge when the walls 28 of the container 27 are progressively compressed.

In the embodiments depicted in FIGS. 4 and 5, where the holding members 4 have a shape similar to that of the container 27, the holding member 4 may also fulfil a function of applying the product onto the strand of hair, which is then coated from two sides. For example, the holding member 4 may be the mirror image of the container 27 relative to a point lying on the connecting strip 3, or relative to an axis intersecting the axis 19 orthogonally.

In another embodiment (not shown), the holding member 4 may have an involute surface more intimately covering the finger on which it is fitted. Since the index finger does not naturally overlap parallel with the thumb, this involute surface makes it possible to promote parallel positioning of the holding member 4 with respect to the applicator portion 2.

Furthermore and in another embodiment (not shown), the holding member 4 may also have teeth, such as the teeth 25 on applicator portion 2. In this embodiment, the teeth may be oriented more or less orthogonally to the blade from which they extend. The strand of hair is, for example, guided between the teeth of the holding member 4 and those of the applicator portion 2.

The device 1 is formed by a single piece, for example obtained by moulding a flexible and pliant material.

In some examples, the device 1 may have a plurality of parts, in which case the connecting element 3 may be a hinge. For example, the teeth 25 may be attached to the applicator portion 2 and/or the holding member 4. The teeth 25 may comprise synthetic or natural bristles, these bristles may be adhesively bonded to the applicator portion 2, for example.

Throughout the description, including the claims, the expression "a" should be understood as being synonymous with "at least one" (i.e., relating to both the singular and the plural) unless otherwise specified to the contrary.

It will be apparent to those skilled in the art that various modifications and variations can be made to the structure described herein. Thus, it should be understood that the invention is not limited to the subject matter discussed in the specification. Rather, the present invention is intended to cover modifications and variations.

What is claimed is:

1. A device for application of a hair product, comprising:

an applicator portion configured to be loaded with hair product, wherein the applicator portion comprises a compressible container, wherein the compressible container comprises a base and teeth about a perimeter of a surface of the base, the teeth and the base being arranged in order to define an interior volume of the compressible container to be occupied by the hair product, wherein the base is configured to prevent flow of the hair product through the base, wherein all teeth of the device comprise non-hollow free ends, wherein an interior of the compressible container is free of teeth and the applicator portion is configured to apply the hair product to at least one strand of hair in response to manual pressure exerted on the container when the device is moved longitudinally relative to the strand of hair;

at least one finger fastener associated with the applicator portion, wherein the finger fastener is configured to allow the device to be fixed to at least one finger of a hand, so as to enable the at least one finger to be positioned so that the base is in-between the finger and the interior volume of the compressible container, wherein the finger fastener comprises at least one elastically deformable tab configured to be placed at least in part around the at least one finger.

2. The device of claim 1, wherein the container comprises a wall, wherein the finger fastener is located on the base, and wherein the wall is compressible in response to a force exerted orthogonally relative to the base.

3. The device of claim 1, wherein the teeth stand upright relative to the base, and wherein the teeth delimit a central depression defined with respect to a surface defined by ends of the teeth.

4. The device of claim 1, wherein the container comprises a wall, and wherein the wall forms a bellows.

5. The device of claim 4, wherein the bellows comprises a shape-memory coil spring.

6. The device of claim 1, wherein the finger fastener is adjustable so as to fix the device to differing sizes of fingers.

7. The device of claim 1, wherein the finger fastener comprises two elastically deformable tabs configured to be connected to one another.

8. The device of claim 7, wherein each of the two elastically deformable tabs extends in opposite directions along a common axis.

9. The device of claim 1, wherein the at least one elastically deformable tab extends in a plane defined by the base.

10. The device of claim 1, wherein the device comprises at least two arc-shaped portions attaching the at least one elastically deformable tab to the base.

11. The device of claim 10, wherein the at least two arc-shaped portions are elastically deformable.

12. The device of claim 1, wherein the finger fastener comprises a stop on an outer periphery of the container, and wherein the stop is configured to limit insertion of the finger relative to the finger fastener.

13. The device of claim 1, further comprising a holding member, wherein the holding member is configured to cooperate with the container to hold the strand of hair in engagement with the container so as to allow the strand of hair to be coated with the hair product.

14. The device of claim 13, wherein the holding member is configured to be folded onto an opening of the container for gripping the strand of hair between the opening and the holding member, and wherein pinching the base of the container and the holding member on either side of the strand of hair exerts the pressure on the container.

15. The device of claim 13, wherein the holding member comprises a plate, and wherein a size of the plate is larger than a size of an opening of the container.

16. The device of claim 13, wherein the holding member comprises teeth.

17. The device of claim 13, wherein at least part of the holding member is at least substantially the same as at least part of the applicator portion.

18. The device of claim 13, wherein the holding member comprises a second finger fastener, and wherein the second finger fastener is configured to be fixed to at least one second finger.

19. The device of claim 18, wherein the second finger fastener comprises at least one elastically deformable second tab configured to be placed at least in part around the at least one second finger.

20. The device of claim 13, further comprising a flexible linking strip, wherein the flexible linking strip connects the holding member to the container.

21. The device of claim 20, wherein the at least one elastically deformable tab extends orthogonally to the flexible linking strip.

22. The device of claim 1, wherein the device is formed from a single unitary piece of material.

23. The device of claim 1, wherein the applicator portion and the finger fastener comprise the same material.

24. The device of claim 23, wherein the device is formed by moulding.

25. A system comprising:

the device of claim 1; and a hair product.

26. A method for applying hair product, the method comprising:

providing the device of claim 1;

fixing the device to the at least one finger of the hand via the finger fastener;

sandwiching the at least one strand of hair between at least one other finger of the hand and at least a part of the device; and exerting manual pressure on the applicator portion so as to apply the hair product to the at least one strand of hair.

27. The method of claim 26, further comprising moving the device longitudinally relative to the at least one strand of hair.

28. The method of claim 26, wherein the hair product is applied in a highlight manner.

29. The method of claim 26, wherein the manual pressure exerted on the container causes compression of the container.

30. The method of claim 26, wherein the device comprises a holding member, and wherein the method further comprises using the holding member to hold the at least one strand in engagement with the container.

31. The method of claim 26, wherein the holding member comprises a second finger fastener, and wherein the method further comprises fixing the second finger fastener to the at least one other finger.

32. The device of claim 1, wherein the base lacks an aperture permitting flow of the product through the base.

33. A device for application of a hair product, comprising:

an applicator portion configured to be loaded with hair product, wherein the applicator portion comprises a compressible container, wherein the compressible container comprises a base and teeth about a perimeter of a surface of the base, the teeth and the base being arranged in order to define an interior volume of the compressible container to be occupied by the hair product, wherein the base extends out at least as far as an outer perimeter defined by outer most portions of the teeth, wherein the base is configured to prevent flow of the hair product through the base, wherein an interior of the compressible container is free of teeth and the teeth comprise non-hollow free ends, wherein the applicator portion is configured to apply the hair product to at least one strand of hair when the device is moved longitudinally relative to the strand of hair; and at least one finger fastener associated with the applicator portion, wherein the finger fastener is configured to allow the device to be fixed to at least one finger of a hand, so as to enable the at least one finger to be positioned so that the base is in-between the finger and the interior volume of the compressible container, wherein the finger fastener comprises at least one tab configured to be placed at least in part around the at least one finger, and wherein the applicator portion and the finger fastener comprise the same material.

34. The device of claim 33, wherein the base lacks an aperture permitting flow of the product through the base.

35. The device of claim 33, wherein the base lacks an aperture permitting flow of the product through the base.

36. A method for applying a hair product, the method comprising:

providing a device comprising an applicator portion configured to be loaded with hair product, and at least one finger fastener configured to allow the device to be fixed to at least one finger of a hand, wherein the applicator portion comprises a compressible container having teeth about the perimeter of a surface of the applicator portion, the teeth being arranged in order to define a volume of the compressible container to be occupied by the hair product, wherein an interior of the compressible container is free of teeth;

fixing the device to at least one finger of a hand via the finger fastener;

loading the container with hair product;

sandwiching at least one strand of hair between at least one other finger of the hand and at least a part of the device; and exerting manual pressure on the applicator portion so as to apply a hair product to the at least one strand of hair.

37. The method of claim 36, further comprising moving the device longitudinally relative to the at least one strand of hair.

38. The method of claim 36, wherein the hair product is applied in a highlight manner.

39. The method of claim 36, wherein the manual pressure exerted on the container causes compression of the container.

40. The method of claim 36, wherein the device comprises a holding member, and wherein the method further comprises using the holding member to hold the at least one strand in engagement with the container.

41. The method of claim 40, wherein the holding member comprises a second finger fastener, and wherein the method further comprises fixing the second finger fastener to the at least one other finger.

* * * * *